US010319504B2

(12) United States Patent
Chien

(10) Patent No.: US 10,319,504 B2
(45) Date of Patent: Jun. 11, 2019

(54) UNIVERSAL MAGNETIC SEALED UNIT

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 15/685,472

(22) Filed: Aug. 24, 2017

(65) Prior Publication Data

US 2019/0066893 A1 Feb. 28, 2019

(51) Int. Cl.
*H01F 7/02* (2006.01)

(52) U.S. Cl.
CPC ..... *H01F 7/0221* (2013.01); *H01F 7/02* (2013.01)

(58) Field of Classification Search
CPC ..... B23Q 3/00; B23Q 3/15; H01F 7/0252; H01F 7/0242
See application file for complete search history.

(56) References Cited

U.S. PATENT DOCUMENTS 3,025,372 A * 3/1962 Benjetsky ..... H01F 7/0242 200/302.3
3,095,525 A * 6/1963 Hansen ..... H01F 7/0252 335/285
3,149,268 A * 9/1964 Hansen ..... H01F 7/0252 248/206.5
3,992,689 A * 11/1976 Kaplow ..... H01F 7/0252 335/302
5,411,231 A * 5/1995 Buck ..... A47G 25/0635 248/206.2
6,366,440 B1 * 4/2002 Kung ..... E05C 19/16 361/147
9,061,400 B1 * 6/2015 Dai ..... B25B 11/002
2011/0056437 A1 * 3/2011 Sprung ..... A01K 63/006 119/51.04
2014/0182088 A1 * 7/2014 Roberts ..... B42F 1/00 24/303
2015/0102879 A1 * 4/2015 Jacobs ..... H01F 7/0247 335/294
2016/0137274 A1 * 5/2016 Peterson ..... B63B 35/7933 114/347

* cited by examiner

*Primary Examiner* — Mohamad A Musleh
(74) *Attorney, Agent, or Firm* — Bacon & Thomas, PLLC

(57) ABSTRACT

A universal magnetic sealed unit has a magnetic piece that never separates from the product and offers a simple magnetic attachment function and/or be incorporated with conductive pieces and/or circuitry or electrical components to offer multiple functions including all kinds of electrical functions for all kinds of product. The sealed unit has an opening to allow the inner magnetic piece to pop-out and contact with a metal piece when the metal piece is within the magnetic force range of the magnetic piece. The magnetic piece will revert back to an initial or horizontal position inside the sealed unit when the metal piece is outside the magnetic force range.

9 Claims, 6 Drawing Sheets

UNIVERSAL MAGNETIC SEALED UNIT

BACKGROUND

There are a number of market-available products having round magnetic-pieces installed on the back of the products so the products can use the magnetic-pieces to be installed or fixed on metallic surfaces. However, the majority of these magnetic pieces are shaped like a cylinder and are installed in or press-fit into recessed cylinder-holes in the product. When the materials used in the products result in physically deformed shapes and dimensions for the recessed cylinder-holes, the cylindrical magnetic pieces will fall out from or separated from the products, causing the products to fall down from the metallic surfaces and inflict damages to the products.

The current invention addresses this problem by providing a never fall-apart magnetic piece for products. In particular, the invention provides a universal magnetic sealed unit that has the following features and advantages:

(1) the universal magnetic sealed unit is very simple to add on to all products using simple tooling or installation by screws or metal-plastic pieces, or a press or physical fit, and/or (2) the universal magnetic sealed unit can pop-out from a recessed position while attaching to a metallic surface while being prevent from falling out of the product by a stop-kit, and/or (3) the universal magnetic sealed unit can revert back to a recessed position when no metallic surface is within a pre-determined distance by a weight balance-theory and/or gravity theory, and/or (4) the universal magnetic sealed unit only requires simple tooling to provide features such as screw holes or posts using easily opened tooling molds having wide application to any products that need a magnetic function to install the product on a metal surface, and/or (5) the universal magnetic sealed unit not only offers never-fall-apart magnetic-piece functions but also offers current delivery when the universal magnetic sealed-unit is incorporated with a conductive metal piece and contacts a metal surface, so that input current passes through the conductive piece to the magnetic piece of the universal magnetic sealed unit to the metal surface, and/or (6) the universal magnetic sealed unit has at least two types:

- (a) one that only offers a magnetic field to allow a product to be fixed or installed on a metal surface.
- (b) one that has a magnetic piece incorporated with a conductive piece or circuitry to delivery electric current and that also has a magnetic field to allow the product to be fixed or installed on a metal surface.

DRAWING

Figure 1:
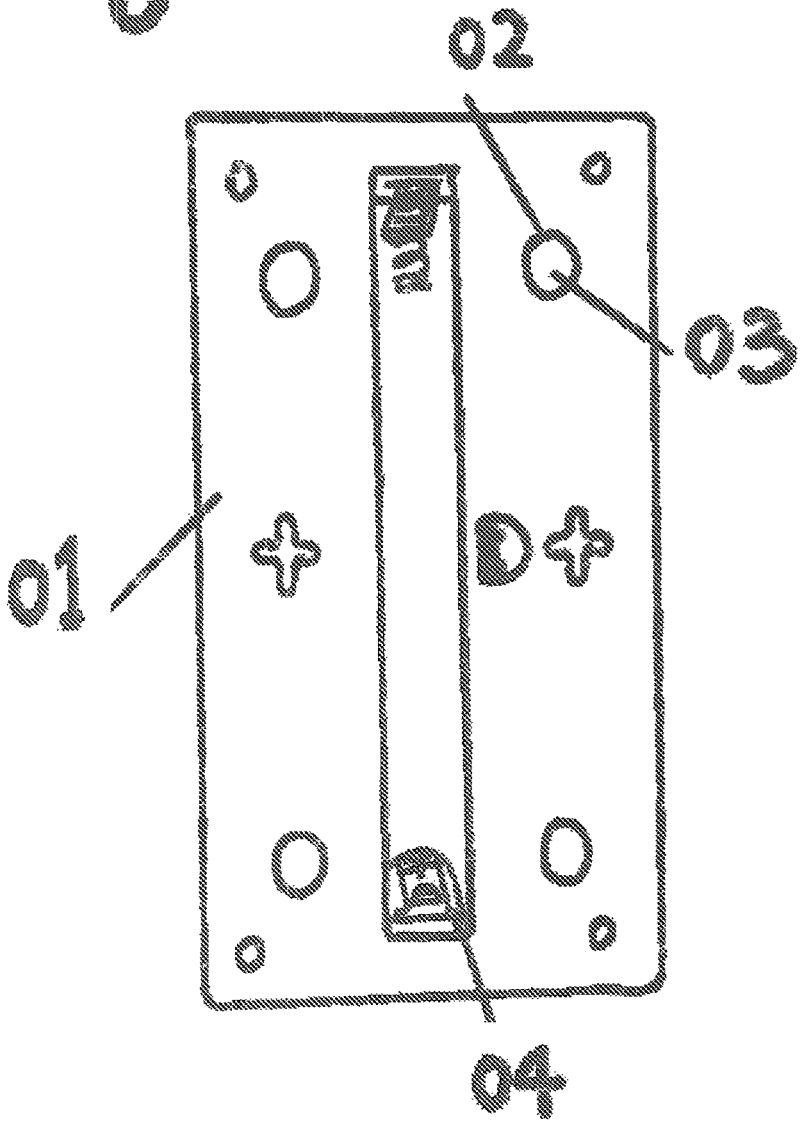
Fig 1 (PRIOR ART)

FIG. 1 shows a traditional market product having a round or cylindrical magnetic piece that fits into the product's round or cylindrical hole, from which the magnetic piece can easily fall.

Figures 2, 2A:
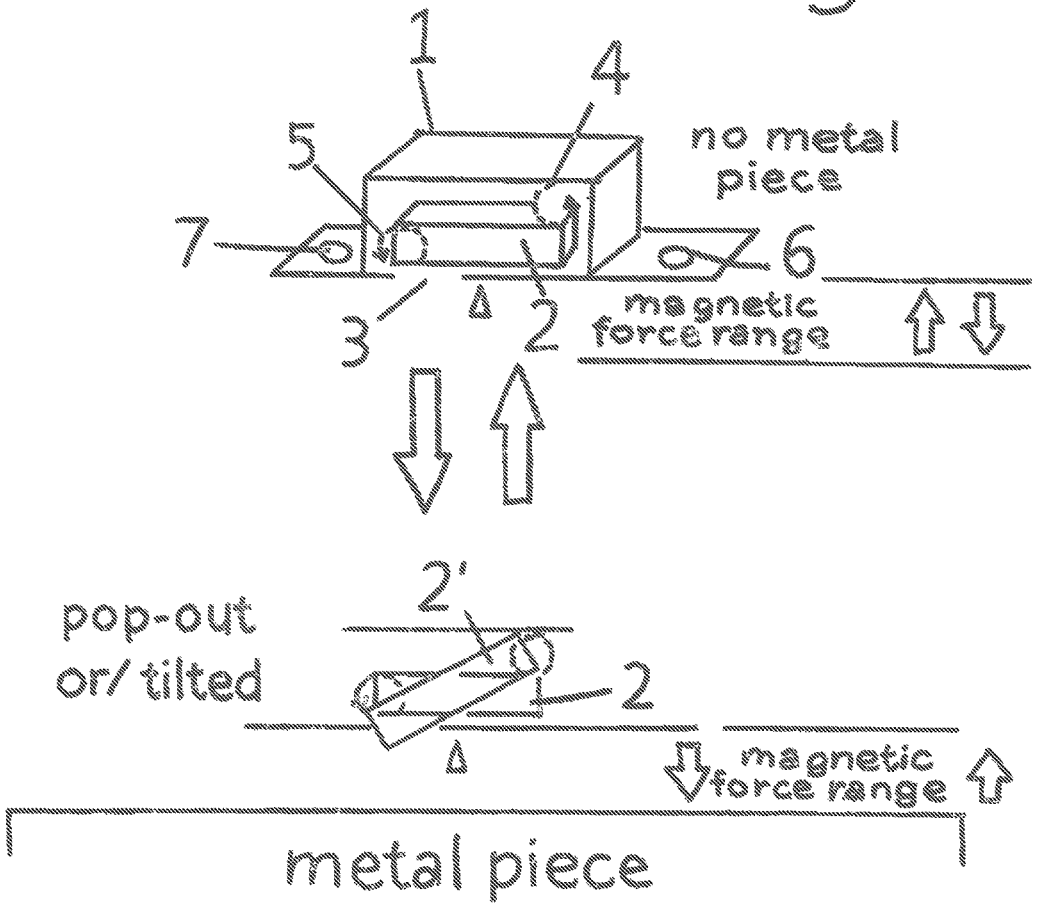

FIG. 2 shows a universal magnetic sealed unit having an inner magnetic piece in a rectangular body and one opening which allows inner magnetic piece to tilt or pop-out and stop when the metal piece is within magnetic field range. Inside the sealed-unit, the inner rectangular body has a longer length or heavier weight body and a shorter length or lighter weight body that is exposed or installed on top of the opening, so that when no metal piece is within magnetic field range the imbalance will cause the rectangular body to move from the tilt/pop-out position back to an original horizontal or recessed position.

Figure 3:
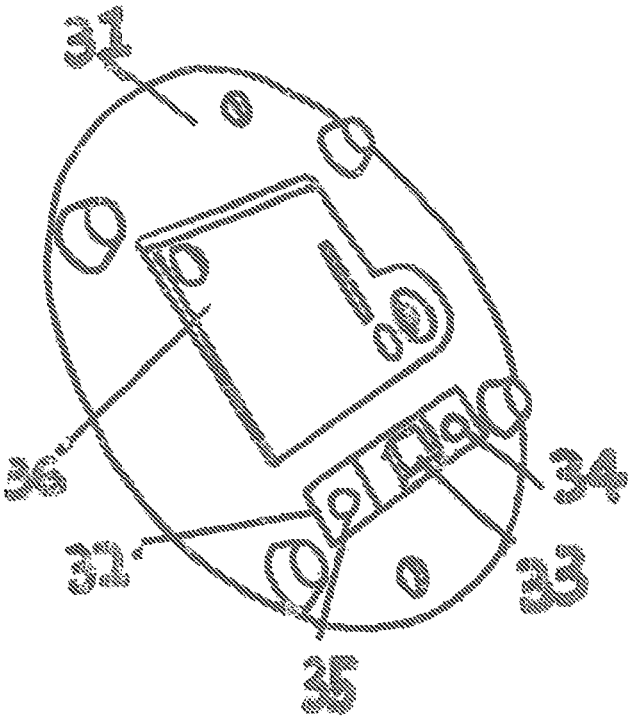

FIG. 3 shows an application which has sealed-unit installed on the back of the product so that the universal magnetic sealed unit can be attached or fixed or installed on the metal surface and well held by magnetic force without any worry that the magnetic-piece will be separated by the relative strength of the magnetic-field attraction to the metal surface compared with a weak holding force provided by press-fitting or gluing the magnetic-piece inside the holes.

Figure 4:
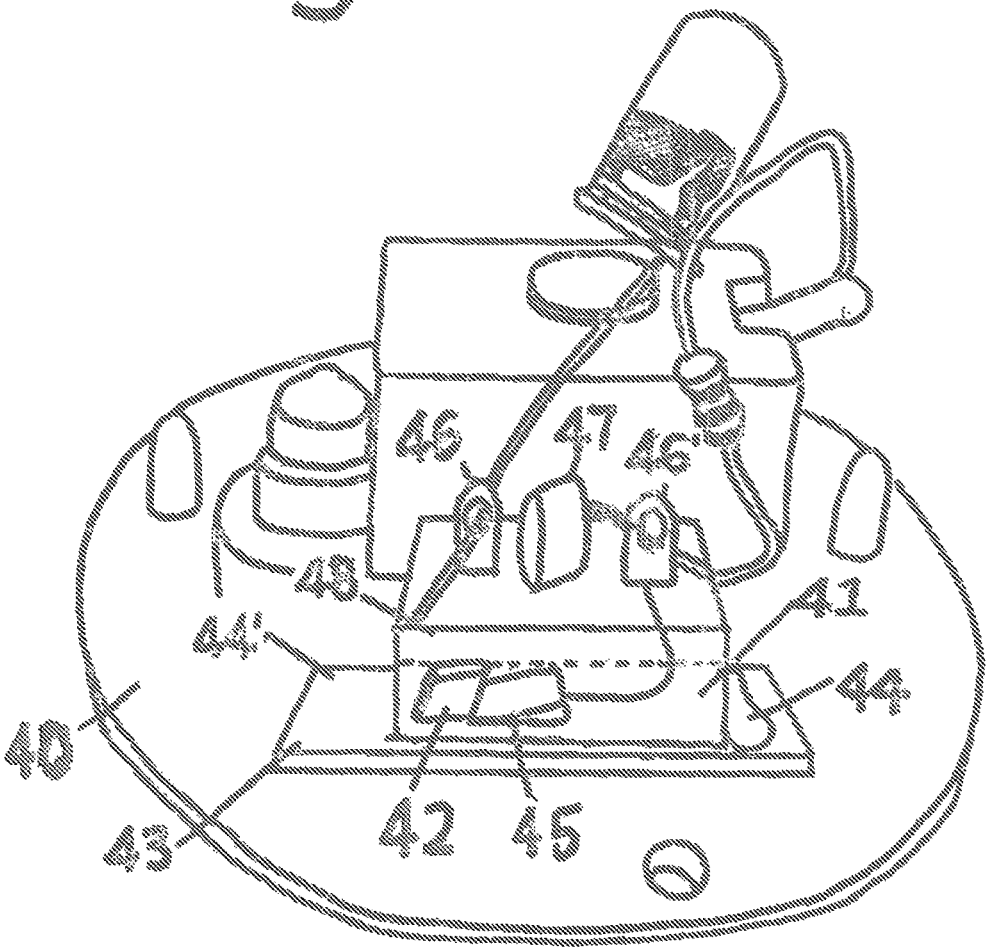

FIG. 4 shows an alternative embodiment which not only has a magnetic function but also delivers electrical current functions when incorporated with conductive parts and/or circuitry and/or an IC and/or a controller system so as to provide an electrical connection.

Figure 5:
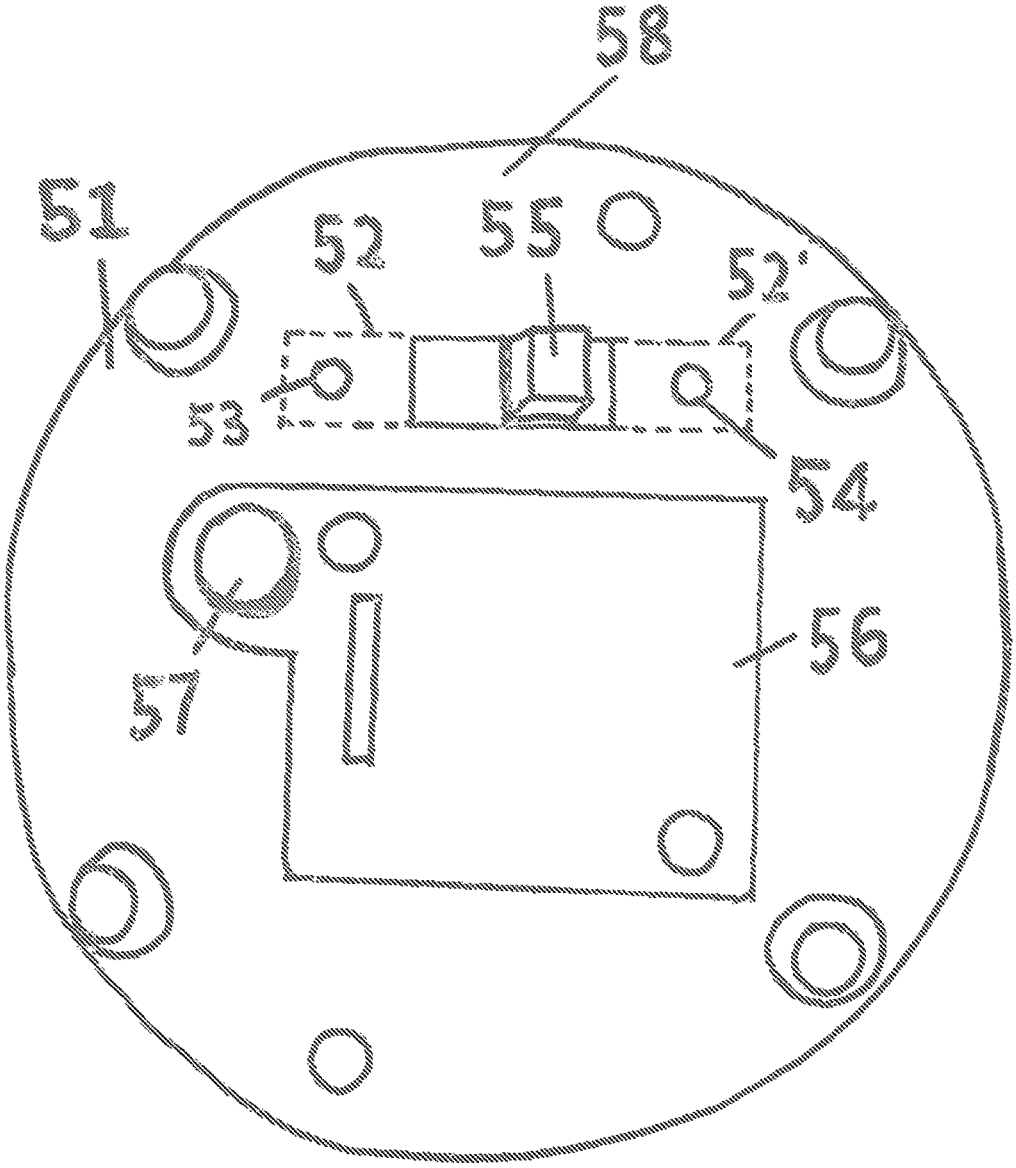
Figure 6:
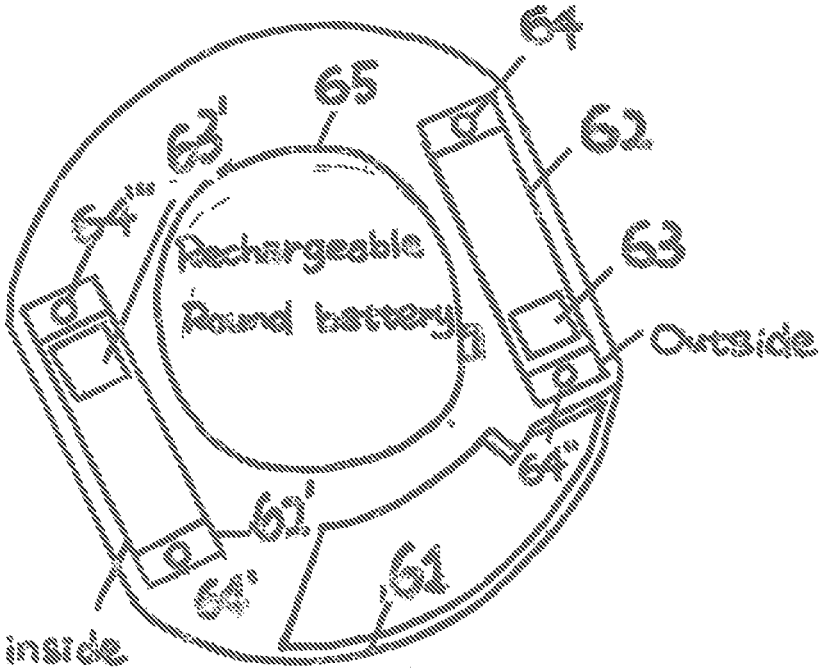

FIG. 5. and FIG. 6 shows other products which have a battery compartment on a back of the products and the universal magnetic sealed units of the invention on the back housing of the products.

DESCRIPTION

FIG. 1 shows a conventional product (01) having magnetic pieces (03) in round or cylindrical holes (02) and a battery compartment (04). This kind of product is usually made by a plastic injection process and the plastic normally is very cheap so heat or high temperatures will have a big impact by causing the plastic to deform and enlarge the round or cylindrical holes so that the magnetic pieces, which are press-fit or glued, will be easily loosened. The magnetic pieces (03) have different magnetic forces based on different specifications, and very powerful magnetic forces will be stronger than the press-fit or push-tight holding force, so the magnetic pieces will instantly be pulled out from the round or cylindrical holes. This is a big problem for all prior arts.

As shown in FIG. 2 and FIG. 2A, the current invention provides a big improvement for traditional market push-tight, fit-tight, or glue-tight recess arrangement for holding the magnetic pieces. FIG. 2 shows a universal magnetic sealed unit (1) which has an inner magnetic piece (2) which can pop-out (2') or tilt (2') to connect with a metal surface (not shown) when the metal-piece (shown on FIG. 2A) is within the magnetic piece's magnetic field.

As shown in FIG. 2 and FIG. 2A, the magnetic-piece (2) is not popped-out or tilted because no metal piece is within the range of the magnetic force of magnetic piece (2). When a metal-piece falls within the magnetic piece (2) magnetic force range, the magnetic-piece will change position from the horizontal or recessed position (2) shown in FIG. 2 to a popped-out or tilted position (2') shown in FIG. 3. When the universal sealed-unit is away from metal-piece, the popped-out or tilted magnetic piece (2') will back to the original or horizontal position (2) shown in FIG. 2. This moving function is caused by the inner magnetic piece having a longer or heavier section that is always inside the sealed-unit. The opening area of the seal unit only has shorter or lighter section so it will move in response to gravity or an imbalance.

FIG. 2 also includes an curved arrow 4 to indicate the movement path of the inner magnetic piece (2) from the horizontal or original position (2) to the pop-out or tilted position (2'). The movement of the top of the magnetic piece (2) will cause it to hit the sealed unit's (1) inner top wall and/or the shorter-section will hit the edge all of the opening (3) edge wall so as to stop and/or prevent the magnetic piece from continuing to move and fall out from opening. This is one preferred construction. It is to be appreciated that any alternative, or equivalent, or replaceable arrangement that enables the magnetic piece (2) to move to and from one of the horizontal and/or pop-out position to the other of the horizontal and/or pop-out position perfectly.

Figure 3A:
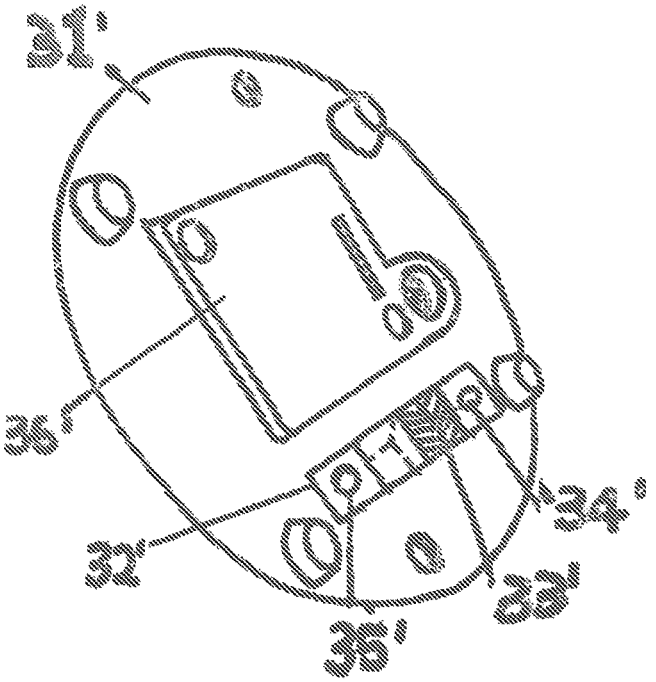

FIGS. 3 and 3A show exemplary embodiments which have housings (31) (31') and outside or inside installation of a universal magnetic sealed unit (32) (32') having a bracket or housing or base or accessories of to allow use of traditional installation or fixing or assembly skills to assembly the added-on sealed-units (32) (32') on the inside or outside of the products. As illustrated, the sealed units are installed on the outside housing of the products.

As shown in FIG. 3 and FIG. 3A, the respective sealed-units (32) (32') have two ears with openings to allow use of screws, posts, solvent or chemical compounds, press-fitting, or ultrasonic sealing to add the sealed-unit on the product. FIG. 3 shows that the magnetic piece (32) is a recessed position. FIG. 3A shows an arrangement in which the magnetic piece (32') is in a pop-out position.

FIG. 4 shows a universal magnetic sealed unit (43) having an opening (42) and inner conductive parts and/or other electric parts and accessories and/or an IC and/or a sensor, switch, remote receiving circuit, or other functional circuitry to delivery electric current or signals to cause the universal magnetic sealed unit to not only provide (1) magnetic force to attach or detach or fix or install on the sealed unit on a metal piece but also to provide (2) a second function of delivering electric current or signals obtain predetermined functions including lighting, sound, wireless remote control, wireless signal delivery, electric functions or functions for eyes to see, ears to hear, a nose to smell, a mouth to eat, and skin to feel.

As shown in FIG. 4, the inner sealed-unit (41) has an opening (42) to allow the magnetic piece (not shown) to move and has a conductive-piece (45) to provide an electric connection with the top of the magnetic piece. The conductive piece (45) also may incorporate other conductive wires to connect with outside conductive terminals (46') which have a connection with other electric-parts (47) selected from, for example, a capacitor, resistor, or other circuits or circuitry or an IC to endow the simple magnetic-piece (not shown) with functions that are in addition to mere attachment to a metal piece, including electric functions of any kind.

The circuit or circuitry of FIG. 4 can be installed outside the sealed unit as an alternative construction. It is appreciated that all the electric parts and accessories can be installed within the sealed unit or outside the sealed unit, and is not limited to the functions described above.

FIG. 5 and FIG. 6 respective show other products having an add-on (a) simple magnetic function sealed unit or (b) a multiple functions sealed unit which have electric related functions. FIG. 6 shows a solid-wire sealed unit (62) installed on the outside of a product and a dotted-line sealed-unit (62') installed inside of the products. Both have a housing, base, bracket, or frame with holes (64) (64') (64") (64") or other arrangements such as a post, bar, pin or extended plastic board to assemble with products by screws, post, bar, or adhesives, or by the use of a solvent to melt and combine with the product's plastic, the use of ultrasonic sealing to combine plastic materials in a solid and tight manner, or staples or rivets which can be selected from market available skills.

FIG. 5 shows another preferred product (51) which has a battery door (56) to allow people to replace the battery. The add-on universal magnetic sealed unit is installed from inside of the product, an opening of which has two ears or flanges to allow use of a melt-plastic-post or screw to fasten tightly onto the product. The two ears can take many different forms, such as flanges made of from a plastic frame with two holes that can be injection molded with the housing of the sealed-unit so as to enable use of melted plastic or solvent to join the plastic material, or the use of an ultrasonic sealing process, or a separate metal frame with two ears to hold the sealed unit and which can use a melted plastic post or bar, or screws, rivets, or stamping with product unit.

As shown in FIG. 6, the products may have a rechargeable battery, the rechargeable battery being charged via two magnetic sealed units combined with conductors to provide both a magnetic attachment function any kind of electrical function.

In summary, the preferred embodiments described above provide a universal magnetic sealed unit 1. that includes at least one magnetic piece and a bracket and/or housing to allow installation on a product by (1) screws, (2) posts, (3) a bar, (4) press-fitting, (5) solvents or glue, (6) chemical fixing compounds, (7) ultrasonic sealing, and/or (8) other installation methods. The sealed unit has at least one opening to allow the inner magnetic piece to (a) tilt or (b) pop-out or (c) move and be stopped by a blocking wall or blocking designs to prevent the inner magnetic piece from falling out or being separated from the sealed unit when a metal surface or metal piece is within the magnetic field of the magnetic piece. The said magnetic piece has a longer and/or heavier weight section that is always inside the sealed unit and a shorter and/or lighter weight section in an opening area, so that when no metal-piece is within the magnetic force range, the shorter or light weight section will move back to back to a horizontal or recessed position from the pop-out or tilted position to which the magnetic piece moves when a metal pieces is within range of the magnetic field. In addition, the universal magnetic sealed unit, the said sealed unit may be incorporated with conductive parts, circuitry, an IC, and/or a PCB to deliver current and/or electric signals to provide predetermined electrical functions.

The invention claimed is:

1. A universal magnetic sealed unit for magnetically attaching a product to a metal surface or metal piece, comprising:

at least one magnetic piece;

a bracket or housing configured to hold the at least one magnetic piece and to be installed on the product by at least one of a mechanical fastener, press-fit, adhesive, solvent, or ultrasonic bond, wherein:

the sealed unit includes at least one opening to enable the at least one magnetic piece to move out of the sealed unit from an original horizontal or recessed position to a popped out or tilted position when the magnetic piece is magnetically attracted to the metal surface or metal piece to which the product is to be magnetically attached, the magnetic piece has a longer or heavier section that remains with the sealed unit and does not extend outside of the opening, the magnetic piece also has a shorter or lighter section that extends outside of the opening to magnetically adhere to the metal surface or metal piece, and the magnetic piece is configured to return to the original horizontal or recessed position when the metal surface or metal piece is outside a magnetic attraction range of the magnetic piece and the magnetic piece is therefore not magnetically attracted to the metal surface or metal piece.

2. A universal magnetic sealed unit as claimed in claim 1, wherein the sealed unit includes a conductive piece or circuitry for establishing an electrical connection with the product to provide an electrical function.

3. A universal magnetic sealed unit as claimed in claim 1, further comprising a wall to prevent the magnetic piece from falling out of the opening of the sealed unit.

4. A universal magnetic sealed unit as claimed in claim 1, wherein the product includes any product configured to be removably attached to the metal surface or metal piece.

5. A universal magnetic sealed unit as claimed in claim 1, wherein the magnetic piece has a magnetic field strength sufficient to magnetically adhere the product to the metal surface or metal piece.

6. A universal magnetic sealed unit as claimed in claim 1, wherein the bracket or housing includes a substrate or base that is fixed to the product.

7. A universal magnetic sealed unit as claimed in claim 1, wherein the mechanical fastener is selected from at least one screw or rivet.

8. A universal magnetic sealed unit for magnetically attaching a product to a metal surface or metal piece, comprising:

at least one magnetic piece;

a bracket or housing configured to hold the at least one magnetic piece and to be installed on the product, wherein:

the sealed unit includes at least one opening to enable the at least one magnetic piece to move out of the sealed unit from an original horizontal or recessed position to a popped out or tilted position when the magnetic piece is magnetically attracted to the metal surface or metal piece to which the product is to be magnetically attached, the magnetic piece has a longer or heavier section that remains with the sealed unit and does not extend outside of the opening, the magnetic piece also has a shorter or lighter section that extends outside of the opening to magnetically adhere to the metal surface or metal piece, and the magnetic piece is configured to return to the original horizontal or recessed position by force of gravity or an imbalance between the longer or heavier section and the shorter or lighter section when the metal surface or metal piece is outside a magnetic attraction range of the magnetic piece and the magnetic piece is therefore not magnetically attracted to the metal surface or metal piece.

9. A universal magnetic sealed unit for magnetically attaching a product to a metal surface or metal piece, comprising:

at least one magnetic piece;

a bracket or housing configured to hold the at least one magnetic piece and to be installed on the product, wherein:

the sealed unit includes at least one opening to enable the at least one magnetic piece to move out of the sealed unit from an original horizontal or recessed position to a popped out or tilted position when the magnetic piece is magnetically attracted to the metal surface or metal piece to which the product is to be magnetically attached, the magnetic piece has a longer or heavier section that remains with the sealed unit and does not extend outside of the opening, the magnetic piece also has a shorter or lighter section that extends outside of the opening to magnetically adhere to the metal surface or metal piece, the magnetic piece is configured to return to the original horizontal or recessed position when the metal surface or metal piece is outside a magnetic attraction range of the magnetic piece and the magnetic piece is therefore not magnetically attracted to the metal surface or metal piece, and sealed unit includes a conductive piece or circuitry for establishing an electrical connection with the product to provide an electrical function.

* * * * *